US006351275B1

(12) United States Patent
Ayling et al.

(10) Patent No.: US 6,351,275 B1
(45) Date of Patent: Feb. 26, 2002

(54) PRINTER WITH BACKGROUND IMAGES

(75) Inventors: Clive Lawrence Ayling, Hauxton; Michel Woodman, Huntingdon; David Roger Tegerdine, Royston; Geoffrey Stuart Howe, Durban, all of (GB)

(73) Assignee: Esselte NV, Sint-Niklaas (BE)

( * ) Notice: Subject to any disclaimer, the term of this patent is extended or adjusted under 35 U.S.C. 154(b) by 0 days.

(21) Appl. No.: 09/628,807

(22) Filed: Jul. 28, 2000

(30) Foreign Application Priority Data

Jul. 30, 1999 (GB) ..... 9918042

(51) Int. Cl.[7] ..... B41J 2/325

(52) U.S. Cl. ..... 347/171; 400/103; 400/104; 400/76; 400/61

(58) Field of Search ..... 367/171; 400/61, 400/65, 76, 103, 104, 615.2

(56) References Cited

U.S. PATENT DOCUMENTS 5,947,819 A * 9/1999 Kurashina et al. ..... 400/76

* cited by examiner

*Primary Examiner*—Huan Tran
(74) *Attorney, Agent, or Firm*—Pennie & Edmonds LLP

(57) ABSTRACT

A printing device comprising user input means having function setting means for selectively instigating a background text state and an edit state and character selection means for selecting characters or symbols to be printed, a label memory for holding label data in the form of characters or symbols selected as background text and characters or symbols selected as foreground text, a printing mechanism for printing images based on said label data and a controller responsive to the user input means and the label data to control the printing mechanism, wherein the controller is operable to generate print data for the printing mechanism to print said selected background characters or symbols as grey shaded background.

14 Claims, 5 Drawing Sheets

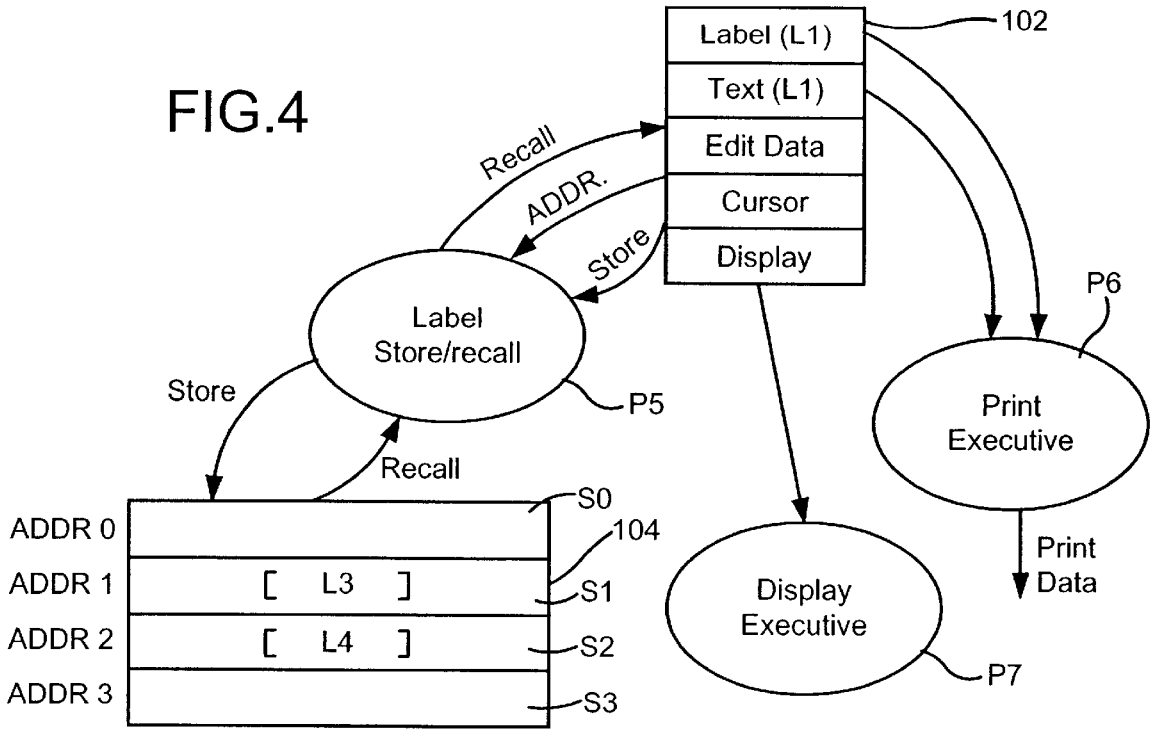
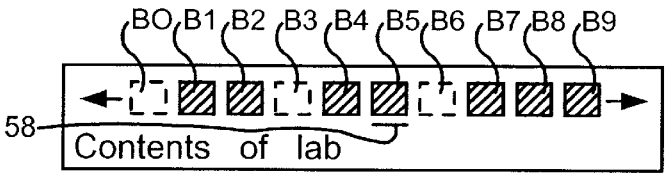
FIG.5
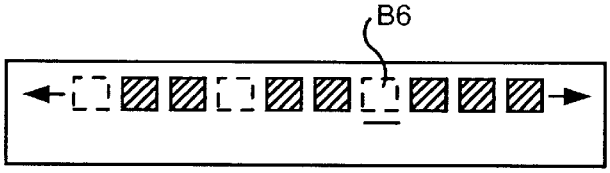
FIG.6
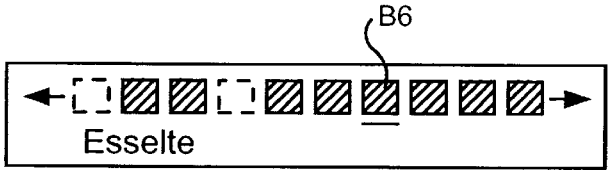
FIG.7

PRINTER WITH BACKGROUND IMAGES

FIELD OF THE INVENTION

The present invention relates to a printing device and a method for printing background images.

BACKGROUND OF THE INVENTION

There are now known thermal printing devices which produce labels having a length corresponding to a message to be printed as defined by a user. Such devices operate with a supply of tape arranged to receive an image and a means for transferring an image onto the tape. In one known device, a tape holding case holds a supply of image receiving tape and a supply of an image transfer ribbon, the image receiving tape and the transfer ribbon being passed in overlap through a print zone of the printing device. At the print zone, a thermal print head cooperates with a platen to transfer an image from the transfer ribbon to the tape. A printing device operating with a tape holding case of this type is described for example in EP-A-0267890 (Varitronics Inc). In this printing device, the image receiving tape comprises an upper layer for receiving an image which is secured to a releasable backing layer by a layer of adhesive.

In another device, the construction of the image receiving tape is such that the upper image receiving layer is transparent and receives an image on one of its faces printed as a mirror image so that it is viewed the correct way round through the other face of the tape. In this case, a double-sided adhesive layer can be secured to the upper layer, this double-sided adhesive layer having a releasable backing layer.

This latter arrangement is described for example in EP-A-0322918 and EP-A-0322919 (Brother Kogyo Kabushiki Kaisha), and in EP-A-0487312 (Esselte N. V.).

Printing devices of this type also include a display means and an input means such as a keyboard for selecting characters to be printed. Selected characters are displayed on the display means and in this way a user can compose a label to be printed. When a label has been composed a print instruction is given and the printing device proceeds to print a label. Printing devices of this type also include cutting means to cut off the printed portion of the tape to enable it to be used as a label For use as a label, the releasable backing layer is removed from the upper layer to enable the upper layer to be secured to a surface by means of the adhesive layer. In this way, labels having a length and character arrangement determined by a user can be made.

Label printing devices of this type are increasingly being provided with a greater variety of images which can be printed. EP-A-600593 describes a tape printing device which has the facility to select pattern data for printing over characters. For example, the pattern data can be a shaded pattern or a framed shaded pattern.

It would be desirable to further enhance the principle facilities of a tape printing device of the aforementioned type.

SUMMARY OF THE INVENTION

According to one aspect of the invention there is provided a printing device comprising: user input means having function setting means for selectively instigating a background text state and an edit state and character selection means for selecting characters or symbols to be printed; a label memory for holding label data in the form of characters or symbols selected as background text and characters or symbols selected as foreground text; a printing mechanism for printing images based on said label data; a controller responsive to the user input means and the label data to control the printing mechanism; wherein the controller is operable to generate print data for the printing mechanism to print said selected background characters or symbols as grey shaded background.

In the described embodiment, the controller is operable to generate print data simultaneously for printing the selected background characters or symbols as grey shaded characters, and for printing the foreground text overlying the background characters. The controller generates print data on a column by column basis by generating a background print column and a foreground print column, and logically combining the background print column and the foreground print column to generate each column of print data. In the described embodiment, the logical combining operation is a logical OR action.

The printing device can include tape width selection means for selecting the width of a tape on which the images are to be printed. The tape width selection means can comprise a switch on the tape printing device which has a plurality of positions, each position denoting a particular tape width or combination of tape widths. The size of the characters selected as background text can be dependent on the width of the tape selected by the tape width selection means. In the described embodiment, if the tape width is below a certain value, no background text is printed. That is, the printing of background text is inhibited for tape widths below a certain value.

Characters for background text can be held in a font memory which in addition holds font data defining characters and symbols to be printed as foreground text. The first font data can be dot pattern data, while the second font data is compressed data. In the following, the background characters and/or symbols are referred to as so-called big font. The big font is held in a compressed format and can be generated in a normal size (for a certain range of tape widths), or a double size (for a range of larger tape widths).

The label memory can comprises a working portion which holds label data defining a label under edit, and a storage portion which holds label data defining stored labels. The label data can include background text labels which, when recalled, are used as background text to generate grey shaded background for input foreground text.

The font memory can, in addition, hold pattern data defining a plurality of selectable background patterns.

Another aspect of the invention provides a method of printing an image on an image receiving medium, the method comprising: instigating a background text state and selecting background image data; instigating an edit state and selecting foreground image data; generating successive print data columns by generating a background print column and a foreground print column and logically combining said background effect print column and foreground print column to generate each print data column; and printing said columns sequentially while moving the image receiving medium past a printing mechanism for printing said columns, wherein said background image data is printed in grey shade.

The foreground text can be printed in full black tone on the grey shaded background. The background image data can comprise selected characters and/or symbols, or can comprise pattern data selected from a plurality of background patterns.

For a better understanding of the present invention and to show how the same may be carried into effect, reference will now be made by way of example to the accompanying drawings.

BRIEF DESCRIPTION OF THE DRAWINGS

FIG. 4 is a diagram illustrating the storage function of the device;

FIGS 5 to 7 illustrate the display at various stages in operation of the device to implement a store or recall function;

DESCRIPTION OF THE PREFERRED EMBODIMENTS OF THE INVENTION

Figure 1:
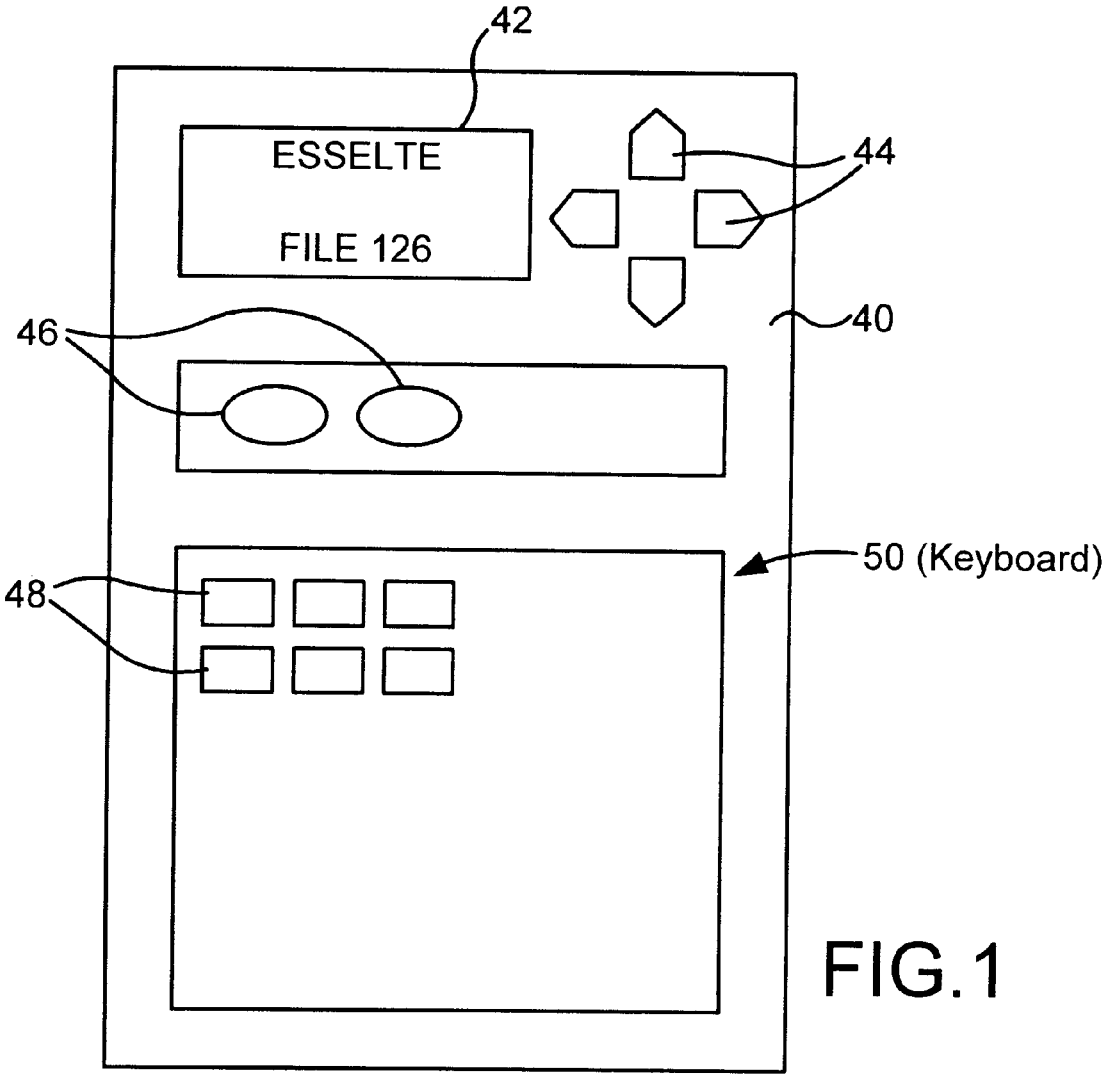
FIG. 1 is a schematic diagram of the front part of the casing of a printing device.

FIG. 1 illustrates the front of a tape printing device. Reference numeral 40 denotes the casework of the printer. The front of the printer carries a liquid crystal display (LCD) 42 and a keyboard 50 having a plurality of cursor control keys 44, a plurality of function keys 46, only two of which are illustrated in FIG. 1, and a plurality of character selecting keys 48, only six of which are illustrated in FIG. 1. The function keys include a return key, a save key, a recall key, a clear key, an edit key and a preview key. As is known, combinations of keys can be used in place of individual keys for each function. The display can display two lines of text. The display is illustrated displaying the two line label (L1) ESSELTE (first line) FILE 126 (second line). As is known, the character selecting keys 48 allow characters to be selected by a user to formulate labels to be printed. The function keys 46 allow different functions to be implemented, and in effect control the operational modes of the printer.

The printer operates with a supply of tape on which images are printed. Lengths of the tape are cut off after a label has been printed. The tape is housed in a cassette which is held in a cassette bay on the underside of the printer.

Figure 2:
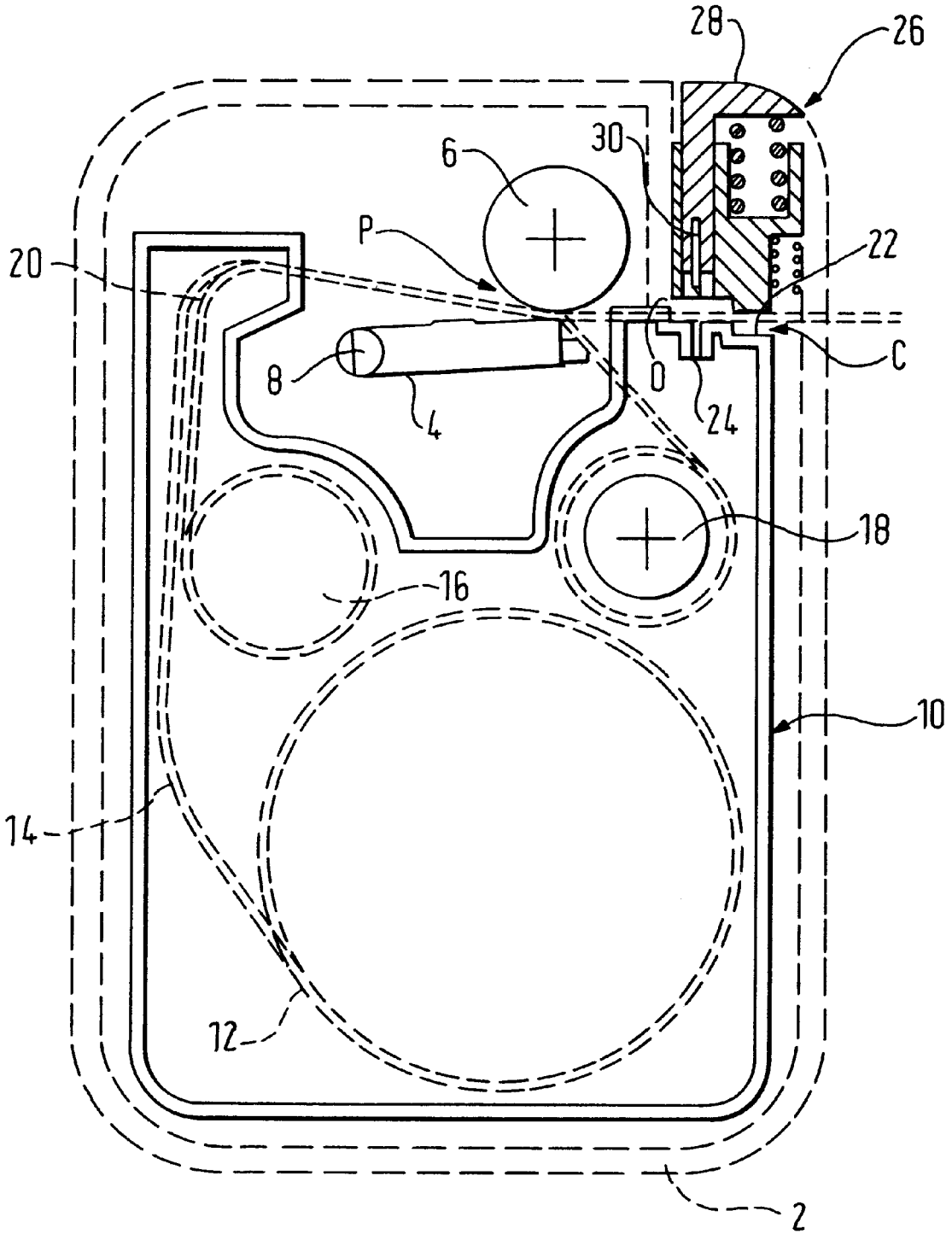
FIG. 2 is a diagram showing the underside of the printing device including the cassette bay and a cassette housed therein.

FIG. 2 illustrates in plan view a cassette bay of a printing device. The cassette bay is shown by the dotted line 2. The cassette bay includes a thermal print head 4 and a platen 6 which cooperate to define a print location P in a manner which is known in the art. The print head 4 is pivotable about a pivot point 8 so that it can be brought into contact with the platen 6 for printing and moved away from the platen to enable a cassette to be removed and replaced.

A cassette inserted into the cassette bay 2 is denoted generally by reference numeral 10. The cassette holds a supply spool 12 of image receiving tape 14 which comprises an image receiving layer secured to a backing layer by a layer of adhesive. The image receiving tape 14 is guided by a guide mechanism (which is not shown) through the cassette, out of the cassette through an outlet O, past the print location P to a cutting location C. The cassette 10 also has an ink ribbon supply spool 16 and an ink ribbon take up spool 18. The ink ribbon 20 is guided from the ink ribbon supply spool 16 through the print location P and taken up on the ink ribbon take up spool 18. The image receiving tape 14 passes in overlap with the ink ribbon 20 through the print location P with its image receiving layer in contact with the ink ribbon.

In the printing device illustrated in FIG. 1, the platen 6 is driven so that it rotates to drive the image receiving tape 14 past the print location P during printing. In this way, tape is printed and fed out from the print location P to the cutting location C. The portion of the wall of the cassette 10 wherein the cutting location C is defined is denoted by reference numeral 22. A slot 24 is defined in this wall portion and the image receiving tape 14 is fed past the print location P to the cutting location C.

The printing device includes a cutting mechanism denoted generally by reference numeral 26. This cutting mechanism includes a cutter support member 28 which carries a blade 30. The blade 30 cuts the image receiving tape 14 and then enters the slot 24 with the leading part of its edge 31 first, rather than bearing against an anvil.

Figure 3:
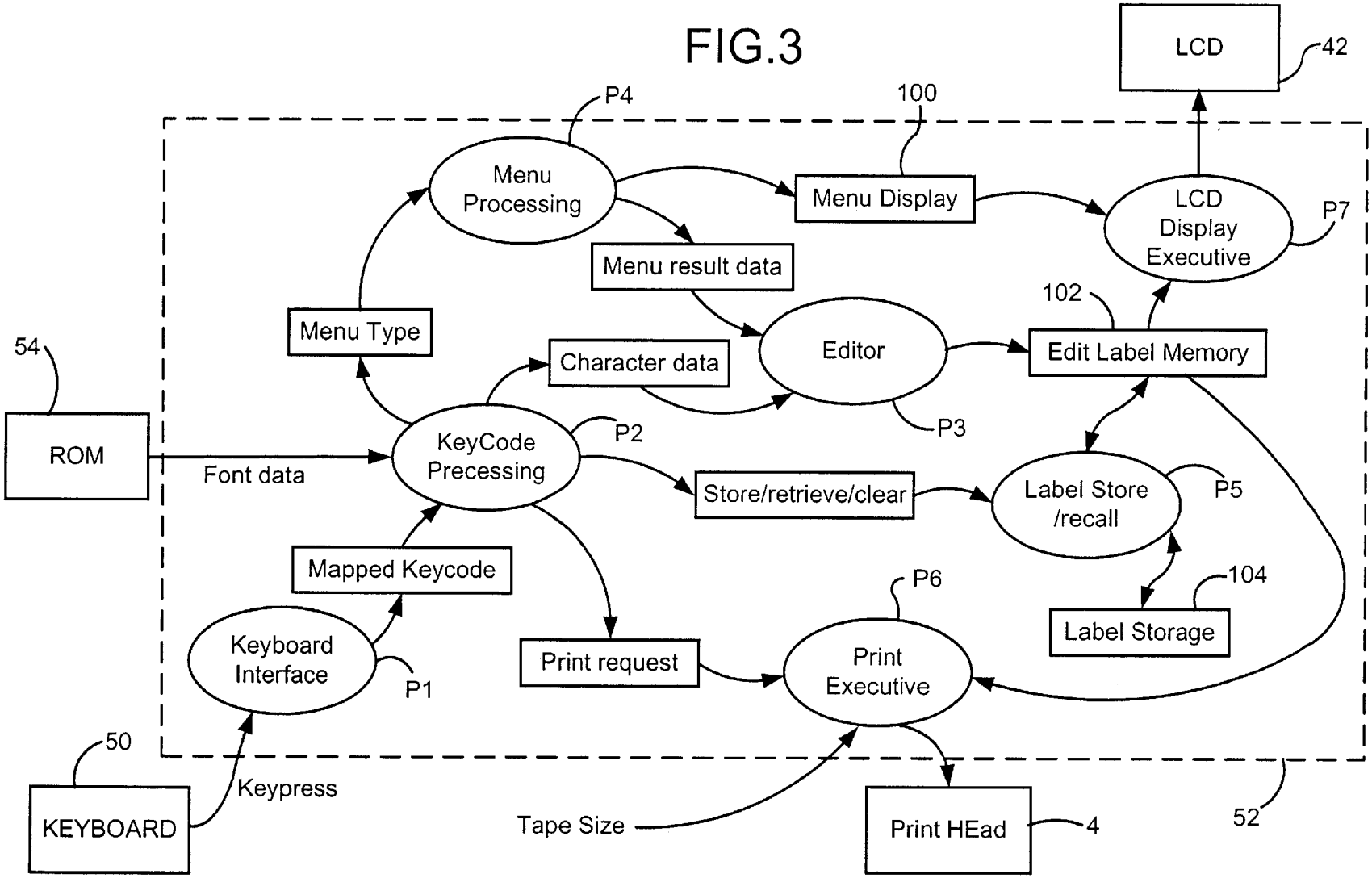
FIG. 3 is a diagram illustrating the control components of the printing device.

FIG. 3 illustrates the control components of the printer. The sketched line 52 represents a print controller which can be for example a microprocessor. The circles within the controller 52 denote program components which are run on the processor to implement different control functions as described in the following. The controller 52 includes or is connected to random access memory (RAM). This RAM is illustrated as distributed in FIG. 3 and it will be understood that it may be implemented on the same chip as the processor, or be provided as a separate chip. The blocks with double lines at the top and bottom labelled 100,102,104 represent portions of RAM. In addition, the controller 52 contains or is associated with a read only memory (ROM) 54 which holds font data for the characters. The controller 52 controls operations of the display 42 and supplies print data to the print head 4. It receives inputs from the ROM 54 and the keyboard 50.

The controller 52 runs a number of different programs to control operations of the printer. A keyboard interface program P1 receives key presses from the keyboard 50 and provides mapped key code data to a key code processing program P2. The key code processing program P2 has a number of different functions. It supplies menu-type data to a menu processing program P4 depending on the menu which is selected by the function keys 46 of the printer. The key code processing program P2 supplies character data to an editor program P3 depending on the characters selected by the character selection keys 48 of the keyboard 50. The key code processing program P2 supplies label store/recall functions to a label store/recall program P5. Finally, the key code processing program P2 supplies print request data to a print executive program P6.

The menu processing program P4 supplies menu result data to the editor program P3 and also supplies menu display data for storage in the RAM portion 100. The editor program P3 acts on the menu result data and character data to formulate and edit a label which is stored in a working portion of the RAM, labelled 102 in FIG. 3. The working portion of the RAM holds data defining the current label which is being formulated and/or edited.

The label store/recall program P5 is operable responsive to store/recall functions supplied from the key code processing program P2 to transfer label data between the working portion 102 of the RAM and a storage portion 104 of the RAM.

The print executive program P6 receives tape size information (discussed later) in conjunction with print requests from the keyboard and controls operation of the print head 4 based on the label data which is held in the working portion 102 of the RAM.

Finally, the controller 52 runs an LCD display executive program P7 which manages data to be displayed on the display 42 based on the contents of the menu display portion 100 of the RAM and the working portion 102 of the RAM.

The printer can accommodate tapes having a plurality of different widths, in particular 6 mm, 9 mm, 12 mm, 19 mm and 24 mm. A switch allows a selection to be made between three settings, 6 mm; 9/12 mm; 19/24 mm. The manner in which this switch cooperates with the printer is described in our earlier European Patent EP634274 and therefore is not discussed further herein. In any event it will be appreciated that any manner of conveying tape size information to the print executive program P6 may be used.

Label data is held in the working portion 102 of the RAM in different data structures as shown in FIG. 4. In particular, a text data structure labeltype (marked text in FIG. 4) holds text data (CharCode) regarding the characters and symbols etc which have been selected for printing. The text data includes new page and new line information. An attribute data structure pagesettingtype (marked label in FIG. 4) holds attributes with which the characters are to be printed, and effectively defines the format of the label. In addition, the working portion 102 of the RAM contains edit data including the position of a cursor as a file cursortype and display control information. At any time, label data and edit data for one label is held in the working portion 102 of the RAM. The data structures labeltype, pagesettingtype, cursortype and displaytype are shown in the form of header files in C in Annexe I.

The print executive program P6 generates print data for the print head as a sequence of columns of dot data based on the text data and attribute data. The edit data is not used for printing. The print executive P6 does not formulate a complete dot pattern image of the label to be printed in RAM prior to printing. Instead, column data is prepared "on the fly". Thus, the print executive program P6 extracts text data from the text data structure and attribute data from the attribute data structure and manipulates this data to generate successive print columns. The print head contains a buffer which holds one column of dot data, while the print head itself prints a column of dot data at a time. Thus, while the print head is printing one column, the next column can be placed in the buffer ready for printing. This technique is described in our earlier European Patent EP513290.

The label storage portion 104 of the RAM comprises a plurality of label storage sections each of which are individually addressable. This is diagrammatically illustrated in FIG. 4 where each label storage section S0 to S3 is marked as a row addressable under addresses ADDR0,ADDR1, ADDR2 etc. Four sections are illustrated although in fact in the preferred embodiment there are ten such sections. Any number of sections can be provided. Moreover, it will readily be appreciated that the organisation of the storage sections in memory is not critical and any suitable organisation and address semantics may be used. The illustration in FIG. 4 is simplified for the purposes of explanation.

Sections can be "full" or "empty". Each full section contains sufficient label data (text and attributes) to define one label. In FIG. 4, sections S0,S3 are empty, sections S1,S2 hold label data defining labels L3,L4 respectively. The label storage sections are used as follows. A user can formulate and edit a label which is held in the working portion 102 of the RAM in an edit mode of the printer. The edit mode is entered by pressing an edit function key 46. In the edit mode, both lines of the two line display 42 display label information allowing a user to enter and formulate character and attribute data to define a label. When the user wishes to store that label into memory, he enters a store mode using a save function key 46. On entering the store mode, the display is as illustrated in FIG. 5, except that in practice the dotted blocks are shown clear on the display. The top line of the display displays a sequence of ten boxes B0 to B9. Each box represents a storage section S0 etc. Block boxes denote a full section and clear boxes denote an empty section. The display also includes a cursor 58 the position of which can be controlled on the display by the cursor control keys 44. This is achieved by the keyboard interface program P1 and the key code processing program P2. When the store mode is entered, the position of the cursor on the display is beneath the box representing the storage section which was last used to store or overwrite a label. In this case, the cursor is under box B5 and let us suppose that that represents storage section S2. The second line of the display shows the first line of the label L4 which is stored in the storage section S2 represented by the box B5, in this case "contents of lab". Actuation of the preview key causes the label contents to scroll along on the display so that the user can see the entire contents of the label.

The user can choose whether to overwrite the contents of a full storage section, or to use an empty storage section by moving the cursor 58 using the cursor position keys 44. In this case we will assume that he wishes to store the label L1 which is just formulated into the storage section S3 represented by the clear box B6. To achieve that, he moves the cursor right until the display is as shown in FIG. 6. In this case of course the second line of the display is clear because the section S3 corresponding to the box B6 is empty. The user then presses a return key which has the effect of transferring the label data from the working portion 102 of the RAM into the storage section S3. The display then looks like FIG. 7. That is, the clear box B6 has now become black to represent a full storage section, and the second line of the display displays the first line of the label L1, that is "ESSELTE". Moreover, the storage section S3 shown empty in FIG. 4 now contains the text data structure and attribute data structure defining label L1 which were previously held in a working portion 102 of the memory.

The above functions are carried out by the label store/recall program P5 responsive to the aforementioned key presses which are processed by the keyboard interface program P1 and the key code processing program P2. Cursor position data is retrieved from the working portion 102 of the RAM and is used by the label store/recall program P5 to address the correct storage section S0 etc in the storage portion 104 of the RAM. Thus, it is an important feature of the label store/recall program P5 that it is capable of accepting cursor position data from the cursor file in a working portion 102 of the memory and using that data to generate addresses for accessing the storage portion 104 of the memory to achieve the functions described above.

Other labels can be formulated and stored up to a maximum of the number of special storage sections provided in the printer. As mentioned, there are ten in the preferred embodiment.

In order to recall stored labels, a user enters recall mode using a recall function key 46. The display appears again as in FIG. 5. That is, the boxes B0 to B9 are displayed on the top line of the display (clear or black), with the cursor 58 below the last used box. Once again assume this was B5. In order to select a stored label, the user moves the cursor 58 using the cursor control keys 44 until the cursor is beneath the desired box. Assume that the user wishes to retrieve the label in Box B6. In that case the display is as in FIG. 7. To select the label, the user depresses the return function key 46 to implement a recall function. This is conveyed to the keyboard interface program P1 and, via the key code processing program P2 to the label store/recall program P5. The cursor position is also conveyed to the label store/recall program to address the storage section S3. On depressing the return key the text data and attribute data are copied from the storage section S3 to the working portion 102 of the RAM. The original data is retained in the storage section S3. The printer enters an edit state in which the whole label is displayed as illustrated in FIG. 1, and the user can then edit or simply print the label by issuing edit command or a print command respectively.

Label data can be removed from a storage section in two ways. It is possible to store labels in a box which is already full, in which case the label data in the working portion 102 of the RAM will overwrite the label data which was stored in that section. It is also possible to clear a storage section by placing the cursor under the selected box and operating a clear function key 46.

The display functions are controlled by the display executive program P7 responsive to the mode of the device and the data held in the working portion 102 of the RAM, in particular the position of the cursor.

The ROM 54 holds font data for defining characters to be printed and displayed. Character data is stored for medium size characters. Small characters are obtained by implementing a half size algorithm prior to generating dot data for printing, and large characters by implementing a double size algorithm.

Normal characters are stored using the following character format indicated in Table 1.

TABLE 1

| | | |
|---|---|---|
| Byte 0 | Bit 7 | Half-size horizontal alignment flag (indicates if the character must be shifted right by one column before half-sizing) |
| | Bit 5–0 | Character width in columns |
| Byte 1 | Bit 7–6 | 2 bit half-sizing mask for even columns |
| | Bit 5–0 | Top row (047) |
| Byte 2 | Bits 7–6 | 2 bit half sizing mask for odd columns |
| | Bits 5–0 | Bottom row |
| Byte 3 | Bit 5 | Character covers rows 0–7 |
| | Bit 4 | Character covers rows 8–15 |
| | Bit 3 | Character covers rows 16–23 |
| | Bit 2 | Character covers row 24–31 |
| | Bit 1 | Character covers rows 32–39 |
| | Bit 0 | Character covers rows 40–47 |

Bytes 4-N consist of the character image data.

In addition, the ROM 54 holds a new type of font, so-called big font. These are stored as 48 dot high characters in compressed format. The compression format is stick, mirror or curve. A letter B for example consists of a stick and two curved components. A letter D consists of a stick plus one curved component. By storing the stick only once, a substantial reduction is achieved in the storage space required.

An alternative compression technique is to store columns of font data with a repeat value where adjacent columns are the same.

Figure 8:
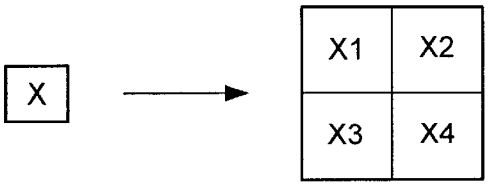
FIG. 8 is a diagram illustrating pixel expansion for double size big font.

Big font can be printed in its so-called normal size (48 dots high) or as a double sized big font to cover 96 dots, which can equate to the full length of the print head. Double sized characters are obtained from the normal size font by double sizing the font pixels as illustrated in FIG. 8. Thus, a single pixel is scaled up to occupy a two pixel by two pixel grid. The values of each of the pixels x1 to x4 in the grid are supplied by a look-up table. That table uses the nearest eight neighbours to product the values x1 to x4. The nearest eight values and the pixel value x are combined to form a single address for addressing four look-up tables, each table producing one of the values x1 to x4. The manner in which double size big font characters are generated is not particularly important, although the aforementioned method is a compact way of achieving this. In principle any known double size algorithm could be used.

The big font character set can be printed such as to generate labels where the text extends more or less the complete width of the tape. The width of the text is in proportion to its height. For example, the word DYMO in big font appears as in FIG. 9. The big font attribute can be selected by cursor selecting a "B" annunciator on the display in size setting mode and then characters are selected and a label formulated as normal. The big font characters also provide another function for the present printer. It allows background text to be printed as a background contrast to foreground text, for example to product labels such as that illustrated in FIGS. 9*a* and 9*b*.

In order to use big font as background text, the user instigates a Background Text State by appropriate function keys 46. When a background text data is entered using certain designated ones of the function keys 46. The display is as illustrated in FIG. 5, that is the first line displays the boxes B0 . . . B9 and the second line displays the first line of the contents of the box under which the cursor is placed. In Background Text State, the cursor appears below the last saved label position used as a background text. If no background labels have been stored the cursor appears on the display under the last saved label. Assuming that no background text labels have yet been stored, a user selects background characters to define background for a label.

The character data is held in the working portion 102 of the memory. Once the background text has been completed, the user exits Background Text State and by depression of the delete key and the printer returns to normal edit mode to allow a user to formulate the foreground text for the label. In order to print the label, a print command is issued. The print executive program P6 formulates dot data for printing by logically ORing the background effect print column with a foreground text print column in each case. Thus, generation of a new print column of data may therefore be split into two operations:

generate the print column based upon the foreground text, superimpose the background effect.

The background effect is generated algorithmically from the compressed font data defining big font.

The background text is printed as grey scale text. To achieve this, the print head is controlled to activate alternate ones of the selected pixels of the print head for each column of background text.

When background text is selected, the formulated background text is repeated without spaces over the entire length of the label on which foreground text is formulated such as to provide a background repeat. That is, any spaces within the text are honoured, but no spaces are introduced between repeats. If necessary, the text will be cut off mid character. In this respect, the background text is treated as a background pattern (discussed later).

It will be appreciated from the foregoing discussion, that in background text state mode it is possible to use an earlier defined background text label by recalling that label from storage and retrieving it to the working portion 102 of the memory. Thus, it is possible to store a number of different background text labels for use with different foreground text.

This can be achieved by storing the foreground text label with a pointer to another label holding background text.

Figure 9A:
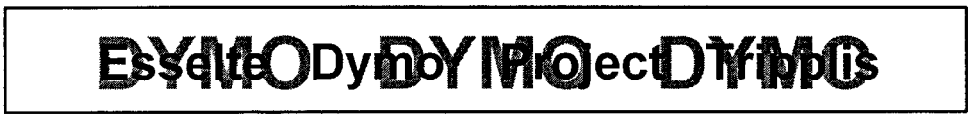
FIGS. 9, 9*a* and 9*b* illustrate background text.
Figure 9B:
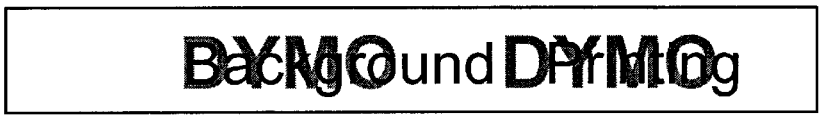
Figure 9:
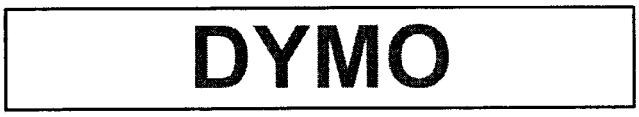

The size of the background characters to be printed depends on the selection of the tape width according to the tape size selection switch. If the tape is 6 mm wide, then no background text is printed. If the tape is 9 mm or 12 mm wide, then background text is printed in normal big font size. If the tape is 19 mm or 24 mm wide, then the background text is printed in double big font size. The examples of FIGS. 9*a* and 9*b* illustrate the word DYMO as background text, repeated a plurality of times. The example of FIG. 9*a* has the text:

"ESSELTE DYMO PROJECT TRIPOLIS"

as foreground text. The example of FIG. 9*b* has the foreground text:

"BACKGROUND PRINTING".

Figure 10:
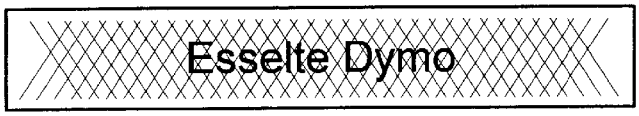
FIG. 10 illustrates a background pattern.

The printer can also print background patterns. A cross-hatched pattern is illustrated as an example in the label of FIG. 10. In order to print background patterns, the user enters a pattern state by selecting appropriate function key 46. If there is already a pattern set, then the pattern function turns off the pattern and the state remains in an edit state. If there is no pattern already set, then the pattern state is entered and the display 42 displays a plurality of icons representing the various patterns available, and a letter to represent the background text function. The cursor is displayed initially below the last used background function. When a background pattern is selected, it is printed over the entire background of the label, depending on the tape width selected according to the tape size setting switch. If the tape is 6 mm wide, then no background pattern is printed. If the tape is 19 mm or 24 mm wide, then the pattern is printed using the full width (96 dots) of the print head. If the tape is 9 mm or 12 mm wide, then a 48 dot pattern is printed. When a background pattern is selected, on instigating print using a print command, the print executive program P6 formulates dot data for printing by logically ORing the background effect print column with a foreground text print column in each case. Thus, a background pattern is printed in a manner similar to that of background text.

ANNEXE 1

```
    Label.h
typedef struct {
    unsigned                boxStyle: 3;
    unsigned                alignment : 2;
    unsigned                mirror: 1;
    unsigned                background: 5;
    uint16                  fixedLength;
    PagesettingType         pageSettings [MAX_PAGES];
    CharCode                next [MAX_TEXT_SIZE]
    PageStruct              pages[MAX_PAGES]
} LabelType;
    Display.h
typedef Charcode DisplayText [DISPLAY LINES][DISPLAY_WIDTH];
    Cursor.h
typedef struct {
    uint8 x; /* character position from left */
    uint8 y; /* line number counting from top downwards */
    CharCode *pos; /* pointer into text */
} CursorType;
    Page.h
typedef struct {
    unsigned justify: 1;
    unsigned style:3;
    unsigned underline: 1;
    unsigned width:2;
```

-continued

ANNEXE 1

```
    unsigned height:2;
    unsigned vertical: 1;
} PageSettingType;
```

What is claimed is:

1. A printing device comprising:

user input means having function setting means for selectively instigating a background text state and an edit state and character selection means for selecting characters or symbols to be printed;

a label memory for holding label data in the form of characters or symbols selected as background text and characters or symbols selected as foreground text;

a printing mechanism for printing images based on said label data;

a controller responsive to the user input means and the label data to control the printing mechanism;

wherein the controller is operable to generate print data for the printing mechanism to print said selected background characters or symbols as grey shaded background.

2. A printing device according to claim 1, wherein the controller is operable to generate print data simultaneously for printing said selected background characters or symbols as grey shaded characters, and for printing said foreground text overlying said background characters.

3. A printing device according to claim 2, wherein the controller is operable to generate print data on a column by column basis by generating a background print column and a foreground print column, and logically combining the background print column and the foreground print column to generate each column of print data.

4. A printing device according to claim 1, which comprises tape width selection means for selecting the width of a tape on which said images are to be printed.

5. A printing device according to claim 4, wherein the size of the characters selected as background text is dependent on the width of the tape selected by the tape width selection means.

6. A printing device according to claim 1, which comprises a font memory holding first font data defining characters and symbols to be printed as foreground text, and second font data defining characters and symbols to be printed as background text.

7. A printing device according to claim 6, wherein the second font data holds said characters and symbols in a compressed format.

8. A printing device according to claim 1, wherein the label memory comprises a working portion which holds label data defining a label under edit, and a storage portion which holds label data defining stored labels.

9. A printing device according to claim 8, wherein said storage portion holds label data defining background text labels in the form of background characters or symbols which, when recalled, are used as background text to generate grey shaded background.

10. A printing device according to claim 6, wherein the font memory holds pattern data defining a plurality of selectable background patterns.

11. A method of printing an image on an image receiving medium, the method comprising:

instigating a background text state and selecting background image data;

instigating an edit state and selecting foreground image data;

generating successive print data columns by generating a background print column and a foreground print column and logically combining said background effect print column and foreground print column to generate each print data column; and printing said columns sequentially while moving the image receiving medium past a printing mechanism for printing said columns, wherein said background image data is printed in grey shade.

12. A method according to claim 11, wherein the foreground text is printed in full black tone.

13. A method according to claim 11, wherein said background image data comprises selected characters and/or symbols.

14. A method according to claim 11, wherein said background image data comprises pattern data selected from a plurality of background patterns.

* * * * *

UNITED STATES PATENT AND TRADEMARK OFFICE

CERTIFICATE OF CORRECTION

PATENT NO. : 6,351,275 B1
DATED : February 26, 2002
INVENTOR(S) : Ayling et al.

It is certified that error appears in the above-identified patent and that said Letters Patent is hereby corrected as shown below:

Title page,
Item [30], Foreign Application Priority Data, please correct the priority application number which should be shown as -- 9918039 --.

Signed and Sealed this

Twenty-fourth Day of September, 2002

*Attest:*

*Attesting Officer*

JAMES E. ROGAN
*Director of the United States Patent and Trademark Office*